US005672315A

United States Patent [19]

Okato et al.

[11] Patent Number: 5,672,315

[45] Date of Patent: Sep. 30, 1997

[54] SUPERPLASTIC DUAL-PHASE STAINLESS STEELS HAVING A SMALL DEFORMATION RESISTANCE AND EXCELLENT ELONGATION PROPERTIES

[75] Inventors: Nobuyoshi Okato; Hiroshi Yoshida; Nobuya Koide, all of Kanagawa, Japan

[73] Assignee: Nippon Yakin Kogyo Co., Ltd., Tokyo, Japan

[21] Appl. No.: 553,097

[22] Filed: Nov. 3, 1995

[51] Int. Cl.[6] ..... C22C 38/42; C22C 38/44

[52] U.S. Cl. ..... 420/40; 420/52; 420/57; 148/325; 148/327

[58] Field of Search ..... 420/40, 52, 57; 148/325, 327

[56] References Cited

U.S. PATENT DOCUMENTS

| | | | |
|---|---|---|---|
| 5,259,443 | 11/1993 | Osada et al. . | |
| 5,298,093 | 3/1994 | Okamoto | 148/325 |
| 5,393,487 | 2/1995 | Matway et al. . | |

FOREIGN PATENT DOCUMENTS

| | | |
|---|---|---|
| 5-70835 | 3/1993 | Japan . |
| 7-41097 | 2/1995 | Japan . |
| 8-13093 | 1/1996 | Japan . |
| 2540283 | 7/1996 | Japan . |
| 2203680 | 10/1988 | United Kingdom . |

OTHER PUBLICATIONS

Patent Abstract of Japan, vol. 96, No. 001. No date available.

Patent Abstract of Japan, vol. 95, No. 002. No date available.

Patent Abstract of Japan, vol. 17, No. 394. No date available.

Japanese Industrial Standard—Cold Rolled Stainless Steel Plates, Sheets and Strip, JIS G 4305–1991.

Nippon Kinzoku Gakkai Kaiho, vol. 18, pp. 192–201, 1979.

Sherby et al., Progress in Materials Science, vol. 33 pp. 169–221, 1989.

*Primary Examiner*—Deborah Yee

*Attorney, Agent, or Firm*—Greenblum & Bernstein, P.L.C.

[57] ABSTRACT

A superplastic dual-phase stainless steel comprises C: not more than 0.05 wt %, Si: not more than 1.5 wt %, Mn: not more than 3.0 wt %, Cr: 17.0–26.0 wt %, Ni: 3.0–10.0 wt %, Mo: 0.1–2.0 wt %, N: 0.08–0.20 wt %, S: not more than 0.002 wt %, B: 0.0005–0.01 wt % and the remainder being Fe and inevitable impurities and has a low deformation resistance and an excellent elongation.

3 Claims, 2 Drawing Sheets

SUPERPLASTIC DUAL-PHASE STAINLESS STEELS HAVING A SMALL DEFORMATION RESISTANCE AND EXCELLENT ELONGATION PROPERTIES

BACKGROUND OF THE INVENTION

1. Field of the Invention

This invention relates to a superplastic dual-phase stainless steel having a small deformation resistance and excellent elongation properties even in the forming work at a relatively low temperature region as compared with the known superplastic dual-phase stainless steel.

2. Description of the Related Art

As the stainless steel developing the superplasticity, there have hitherto been well-known pitting-resistant dual-phase stainless steels exemplified by SUS 329J4L and so on. This dual-phase stainless steel was naturally designed to improve the corrosion resistance under service environment in sea water or the like and had a two-phase structure consisting of austenite and ferrite. It is considered that these two phases interact to each other for the control of the grain growth to maintain fine recrystallized grains during the high-temperature deformation and hence develop a good superplasticity.

When the two-phase stainless steel of SUS 329J4L is applied to applications requiring the superplasticity, e.g. one-piece molded bodies having a complicated shape such as sink, golf clubhead and the like, it is necessary to conduct the molding (superplastic molding) at a temperature above 1000° C., because when the molding is carried out at a temperature below the above value, σ phase being a hard intermetallic compound is precipitated in the deformation.

As regards the σ phase, there are a report that "it controls the growth of grains to enhance the superplasticity" and report that "it is hard and increases the deformation resistance to degrade the superplasticity". However, when this phase is existent in the material at room temperature, the toughness of the material is considerably degraded, so that it is finally necessary to completely remove the phase from the material. As a method of removing this phase, there are a method of superplastic-molding the material at a temperature higher than a precipitation temperature region of σ phase and then quenching it, and a method of holding the material after the superplastic molding at a temperature higher than the precipitation temperature region of σ phase and then quenching it. However, the superplastic material is very soft at a high temperature and is easy to change the shape in the heat treatment, so that it is impossible to actually conduct the heat treatment after the forming (molding).

Therefore, when the dual-phase stainless steel is utilized as a superplastic material, it is required to conduct the molding at a temperature region not precipitating the σ phase.

On the other hand, it is demanded to generate (bring out) the superplasticity at a lower temperature region, e.g. about 900° C. as regards the dual-phase stainless steel. Because, if the superplasticity can be developed at the low temperature, the forming conditions at higher temperature can be mitigated to more stably realize the forming and also the installation design can be carried out easily and cheaply, so that the development of superplasticity at the low temperature serves to reduce the molding cost and shorten the molding cycle.

In general, the conventional dual-phase stainless steels have been mainly developed for the improvement of the corrosion resistance, but are not designed for developing (generating) so-called superplasticity and improving it.

In spite of the above demands, it is actual that the technique for generating the superplasticity at the low temperature is not yet established in the conventional dual-phase stainless steel.

SUMMARY OF THE INVENTION

It is, therefore, an object of the invention to more improve the superplasticity of the stainless steel and to propose a superplastic dual-phase stainless steel capable of developing an excellent superplasticity at a temperature region lower than the conventionally used temperature region while maintaining the corrosion resistance inherent to the stainless steel.

In order to develop the excellent superplasticity at a low temperature region of about 900°0 C., the steel material is required to a stress required for the deformation at such a low temperature region or a low flow stress and a high strain rate exponent or m-value without precipitating σ phase. Moreover, the m-value means a numerical value of m having a relation represented by the following equation:

$$\ln \delta = m \times \ln \epsilon + C$$

(wherein δ is a stress, ϵ is a strain rate, and C is a constant).

Although the main object lies in the improvement of the superplasticity, if the steel material after the superplastic forming does not exhibit an adequate corrosion resistance, the characteristics as the stainless steel are lost, so that it is necessary to maintain the corrosion resistance to a certain extent. That is, it is demanded to develop materials having a low flow stress at a low temperature region of about 900° C. and excellent elongation and corrosion resistance.

With the foregoing in mind, the inventors have made various studies with respect to various alloying components for achieving the above object and developed superplastic dual-phase stainless steel having an excellent superplasticity at a low temperature region of about 900° C., no precipitation of σ phase and a practical corrosion resistance.

According to the invention, there is the provision of a superplastic dual-phase stainless steel having a low deformation resistance and an excellent elongation, comprising C: not more than 0.05 wt %, Si: not more than 1.5 wt %, Mn: not more than 3.0 wt %, Cr: 17.0–26.0 wt %, Ni: 3.0–10.0 wt %, Mo: 0.1–2.0 wt %, N: 0.08–0.20 wt %, S: not more than 0.002 wt %, B: 0.0005–0.01 wt % and the remainder being Fe and inevitable impurities.

In a preferable embodiment of the invention, the steel contains Cu: 0.1–2.0 wt %.

In another preferable embodiment of the invention, the steel further contains 0.005–0.05 wt % of REM (rare earth element).

In the other preferable embodiment of the invention, contents of Cr, Ni, Mo, Si, C, Mn, Cu and N satisfy a difference between $Cr_{eq}$ defined by the following equation (1) and $Ni_{eq}$ defined by the following equation (2) [$Cr_{eq}$–$Ni_{eq}$] of 12.0–17.0.

$$Cr_{eq} = Cr + Mo + 0.5Si \quad (1)$$

$$Ni_{eq} = Ni + 30C + 0.5Mn + 0.5Cu + 20N \quad (2)$$

BRIEF DESCRIPTION OF THE DRAWINGS

The invention will be described with reference to the accompanying drawings, wherein.

DESCRIPTION OF THE PREFERRED EMBODIMENTS

Figure 1:
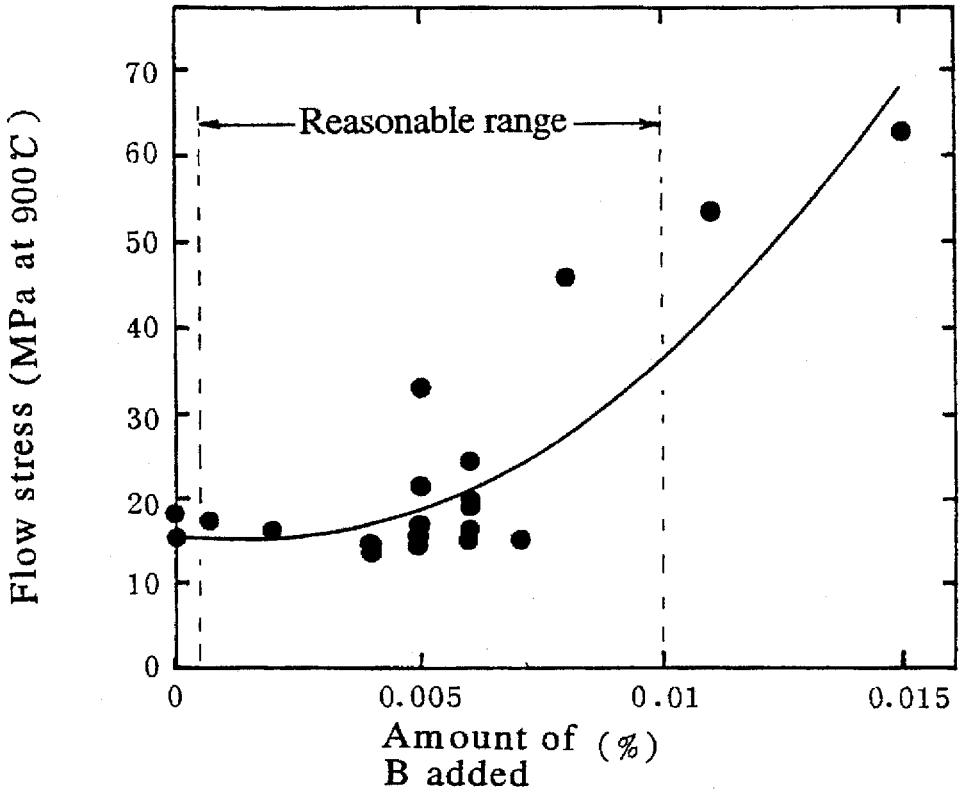
FIG. 1 is a graph showing a relation between flow stress and amount of B added.

The reason why the content of each alloying component in the dual-phase stainless steel according to the invention is restricted to the above defined range is described below.

C: not more than 0.05 wt %

When the C content exceeds 0.05 wt %, the susceptibility to intergranular corrosion increases to degrade the resistance to pitting corrosion and also the hot workability is lowered by the precipitation of carbide. Even when the material is a superplastic material, if the C content exceeds 0.05 wt %, the curing is caused in the cold rolling and the handling in subsequent work or the like becomes difficult. Therefore, the upper limit of C content is 0.05 wt %.

Si: not more than 1.5 wt %

Si is an element constituting the σ phase as an intermetallic compound. As the Si content increases, the σ phase precipitating rate becomes faster and hence the rise of the upper limit temperature within a precipitation temperature range is observed. Therefore, in order not to cause the precipitation of σ phase at about 900° C., the Si content is required to be not more than 1.5 wt %.

Mn: not more than 3.0 wt %

Mn acts as a deoxidizing element in the melting and refining and is an element effective for preventing hot shortness by reacting with S to form a sulfur compound. When the Mn content exceeds 3.0 wt %, the oxidation resistance is degraded. Therefore, the Mn content is necessary to be not more than 3.0 wt %.

Cr: 17.0–26.0 wt %

Cr is an element forming ferrite and constituting σ phase. When the Cr content exceeds 26 wt %, the precipitation of σ phase becomes conspicuous and even if the amount of the element promoting the precipitation of σ phase such as Si or the like is less, the precipitation of σ phase is caused at about 900° C. and hence the hot workability and the superplasticity at a temperature region forming σ phase are degraded, so that the upper limit is 26.0 wt %. On the other hand, when the Cr content is less than 17.0 wt %, the amount of austenite increases likewise the Ni content mentioned below and the effect of controlling the γ-grain growth through α phase is lost and the degradation of the superplasticity is caused and also the oxidation resistance of steel is lowered to considerably cause the oxidation of the steel material in the holding at a high temperature for a long time during the superplastic molding and hence the good elongation can not be obtained, so that the lower limit is 17.0 wt %.

Ni: 3.0–10.0 wt %

Ni is an austenite forming element. When the Ni content is less than 3.0 wt %, even if the adjustment is carried out by the addition of the other ferrite forming element or austenite forming element, the ratio of γ (austenite) phase is not more than 30 wt % and the effect of controlling the grain growth of α (ferrite) phase during the superplastic deformation lowers to degrade the superplasticity, so that the lower limit is 3.0 wt %. On the other hand, when it exceeds 10 wt %, the ratio of γ phase becomes inversely high and the rate of grain growth of γ phase increases to raise the flow stress of the material at the high temperature, so that the upper limit is 10.0 wt %.

Mo: 0.1–2.0 wt %

Mo is an element playing a very important role in the dual-phase stainless superplastic material because Mo is an element contributing to the improvement of corrosion resistance such as resistance to pitting corrosion, resistance to crevice corrosion and the like after the work and is an important element indispensable to the corrosion resistant dual-phase stainless steel. As a result of the inventors' experiments with respect to the superplasticity of the dual-phase stainless steel, it has been confirmed that Mo acts to promote the precipitation of σ phase and considerably raises the flow stress (deformation resistance in the superplastic deformation). Particularly, the rise of the flow stress becomes conspicuous at a low temperature region of about 900° C., which also becomes remarkable when the Cr content exceeds 2.0 wt %. Therefore, the upper limit of Mo is 2.0 wt %.

On the other hand, Mo acts to considerably improve the oxidation resistance of the material at the high temperature. Therefore, the steel material containing no Mo is low in the flow stress, but is exposed at the high temperature for a long time, in forming as good results is not obtained in the superplastic elongation. In this connection, it has been confirmed from the inventors' experiments that when not less than 0.1 wt % of Mo is added to the above material, the superplastic elongation is considerably improved. Therefore, the lower limit of Mo is 0.1 wt %.

Cu: 0.1–2.0 wt %

In general, blow molding through a lower gas pressure as compared with the usual molding work is adopted as the superplastic forming in order to cope with complicated shape and reduce a mold cost. Therefore, in order to put the superplastic dual-phase stainless steel into practical use, it is necessary to lower the flow stress of the material. However, when the temperature of superplastic forming is lowered from the usually used 1000° C. to 900° C., the increase of the flow stress is remarkable in the dual-phase stainless steel. As a result, the reduction of flow stress is a most important matter in order to put the superplastic dual-phase stainless steel into practical use.

The inventors have made studies with respect to the superplasticity of the dual-phase stainless steel and found out that Cu is generally an element contributing to the improvement of corrosion resistance and resistance to crevice corrosion but has an effect of decreasing the flow stress. When the Cu content exceeds 2.0 wt %, the lowering of the superplastic elongation is unfavorably caused, so that the upper limit is 2.0 wt %. On the other hand, the lower limit is 0.1 wt % beginning to develop the effect of improving the flow stress. Preferably, it is desirable that the Cu content of not less than 1.0 wt % develops the effect of considerably decreasing the flow stress.

The effect of Cu addition as mentioned above puts the superplastic dual-phase stainless steel into practical use. Although the detail mechanism of decreasing the flow stress through Cu is not yet clear, it is considered that Cu segregates in the grain boundary to facilitate the slipping of the grain boundary to thereby decrease the flow stress.

N: 0.08–0.20 wt %

N is an austenite forming element likewise C. In order to provide the excellent superplasticity, therefore, it is necessary that the N content is determined by sufficiently considering the structure balance in view of the other ferrite forming element, because the formation of fine crystal grains required for the generating of the superplasticity is most largely dependent upon amounts of γ phase and α phase as mentioned below. Concretely, the N content is preferable to satisfy that the value of $[Cr_{eq}-Ni_{eq}]$ is within a range of 12.0–17.0.

Furthermore, N has an effect of improving the resistance to pitting corrosion. In order to obtain such an effect, the N content is required to be not less than 0.08 wt %. However, when the N content exceeds 0.20 wt %, the hot workability becomes vary poor. Therefore, the N content is 0.08–0.20 wt %.

S: not more than 0.002 wt %

It is known that S is segregated into the grain boundary to considerably degrade the hot workability of the dual-phase stainless steel. Therefore, it is preferable that the S content is practically restricted to not more than 0.002 wt % to ensure the hot workability.

B: 0.0005–0.01 wt %

It is known that B is segregated into the grain boundary to strengthen the grain boundary, but causes the rise of flow stress. Therefore, the addition of B has hitherto been considered to be disadvantageous for the improvement of the superplasticity. According to the inventors' experiments, however, it has been confirmed that when B is added in an amount of not less than 0.0005 wt %, a very high elongation is obtained and it is effective to the improvement of the superplasticity. That is, B is an element playing a very important role in the invention. The above function and effect are remarkably observed in an Ar atmosphere having no influence of oxidation.

Concretely, the effect of improving the superplastic elongation is confirmed at the addition of not less than 0.0005 wt %, and the addition amount of not less than 0.005 wt % is said to be preferable. However, when the addition amount exceeds 0.01 wt %, B compound is precipitated in the grain boundary to bring about the rapid rise of flow stress and the effect of improving the superplastic elongation is not obtained. Therefore, the B content is restricted to a range of 0.0005–0.01 wt %.

REM: 0.005–0.05 wt %

As previously mentioned, when the superplastic dual-phase stainless steel is generally subjected to superplastic molding, the working temperature is as very high as about 900°–1000 C. Therefore, when the molding takes a long time, the material itself is required to have an oxidation resistance to a certain extent. Because, if there is no oxidation resistance, the oxidation proceeds into an interior of the material accompanied with the deformation of the material and hence the occurrence of voids and the breakage of the material are caused and the practicality is lacking.

In this connection, the inventors have noticed REM (at least one selected from rare earth elements or a mixture of two or more thereof such as Mish metal, and particularly La, Ce and Y are preferable) as an element contributing to improve the oxidation resistance of the superplastic dual-phase stainless steel.

There have hitherto been reported many studies on the improvement of oxidation resistance by the addition of REM (e.g. Nippon Kinzoku Gakkai Kaiho, vol. 18, p192, 1979 and the like). There reports are mainly related to ferritic steel materials, but there is substantially no report on the dual-phase stainless steel. Because, the effect of REM on the oxidation resistance generally lies in a point of improving the adhesion property of oxidation scale, so that it is considered that the above effect is not substantially recognized by tests of repetitive oxidations or the like in the dual-phase stainless steel simultaneously containing α phase and γ phase with a large difference of thermal expansion.

In this point, the inventors' experiments for the superplastic elongation are carried out while maintaining the material at a constant temperature, so that the effect of REM is considerably developed even in the dual-phase stainless steel, and consequently it has been confirmed that the oxidation resistance of the material is largely improved to provide a steel material exhibiting an excellent superplastic elongation.

As mentioned above, REM is an element contributing to the improvement of oxidation resistance in the superplastic work. However, when the content exceeds 0.05 wt %, REM causes surface defect or remains in steel as a non-metallic inclusion to degrade the corrosion resistance. Therefore, the upper limit is 0.05 wt %, while the lower limit is 0.005 wt % developing the effect of improving the oxidation resistance.

$[Cr_{eq}-Ni_{eq}]$: 12.0–17.0.

There have hitherto been reported many studies on the mechanism of developing the superplasticity of the dual-phase stainless steel, and among them there are many reports on the influence of alloying elements, influence of work state, influence of σ phase precipitation and the like. The inventors have made experiments on the dual-phase stainless steel having a wider α/γ ratio composition in order to examine the influence of α/γ grain boundary which is considered to play a most important role in the superplastic deformation of the dual-phase stainless steel. As a result, it has been found out that the α/γ ratio is strongly interrelated to a strain rate exponent (m-value) as one of superplastic properties. That is, the above α/γ ratio can be indicated by $[Cr_{eq}-Ni_{eq}]$. It has been found that when this value is within a preferable range, the high m-value is obtained, but when the value of α is outside the above range, the m-value tends to be decreased.

According to the article "Progress in Materials Science", vol. 33 (1989), p169, there is mentioned a point that two phases constituting the fine superplastic material control the grain growth with each other in the course of superplastic deformation through Zener effect of these phases and activate the grain boundary sliding while maintaining fine recrystallized grains without reducing the grain boundary area. Furthermore, it has been mentioned that the structure ratio of the two phases is desirable to be 50:50 for controlling the grain boundary of different phase, which is assumed that the strength levels of the two phases are equal or near to each other. However, the strength of γ phase is higher than that of α phase under the superplastic deformation, so that it is advantageous that soft matrix phase is preferable rather than hard matrix phase considering the reduction of deformation resistance. Therefore, it is necessary that the soft α phase is made higher than the ratio of α and γ phases of 1:1.

For this end, the above $[Cr_{eq}-Ni_{eq}]$ as an indication of the ratio of α and γ phases is restricted to satisfy a range of 12.0–17.0. That is, when $[Cr_{eq}-Ni_{eq}]$ is not less than 12.0, the matrix phase can be softened, while when $[Cr_{eq}-Ni_{eq}]$ is not more than 17.0, the effect of controlling the grain growth of different phase is not obstructed.

The following examples are given in illustration of the invention and are not intended as limitations thereof.

Ten kg of dual-phase stainless steel having a chemical composition shown in Table 1 is melted in a high frequency induction heating furnace under atmosphere, which is cast into a mold of 10 kg, hot forged at a temperature region of 1150°–1200° C. to a thickness of 10 mm. Thereafter, the forged sheet is subjected to a solution treatment at a temperature region of 1000°–1200° C., descaled and subjected to a cold rolling at a draft of 84% to a thickness of 1.6 mm, from which a test specimen is prepared. Moreover, the test specimen has a shape of 10 mm in length and 5 mm in width.

The thus obtained test specimen is heated at 900° C. as a superplastic molding temperature and held at this temperature for about 70 minutes, which is subjected to a tensile test for the evaluation of superplasticity. As the tensile test, a step-strain-rate method used as a high-temperature strength testing method is adopted instead of the usual uniaxial tensile test having a constant crosshead speed. In the step-strain rate method, the tension is started at a very low crosshead speed (0.005 mm/min) and then the crosshead speed is raised by steps at a time of reaching to a stress peak, during which the stress peak is measured every crosshead speed and such a procedure is continued up to a crosshead speed of 20 mm/min, whereby the deformation resistance (flow stress) and strain rate exponent (m-value) can relatively and simply be determined.

Although the superplasticity is not clearly defined, it is generally judged that when the elongation is not less than 200% and the m-value is not less than 0.3, the superplasticity is developed. In addition to these two indications, there is a deformation resistance (flow stress) as an important factor in the actual superplastic work. Therefore, the superplasticity is evaluated by the above three indications of flow stress, m-value and elongation. The results are shown in Table 1.

As seen from the results of Table 1, the steels according to the invention show good values of the three indications because the flow stress is not more than 20 MPa at 900° C. and the m-value is more than 0.75 and the elongation is not less than 1000%.

On the contrary, in the comparative steels having the chemical composition outside the range defined in the invention, the development of the superplasticity is recognized, but at least one of the flow stress, m-value and elongation is poor , from which the superplasticity is excellent in the steels according to the invention that in the comparative steels.

TABLE 1

| | Chemical composition (wt %) | | | | | | | | | | | | * $Cr_{eq}$ − $Ni_{eq}$ | Flow stress (MPa) | m-value | Elongation (%) | Remarks |
|---|---|---|---|---|---|---|---|---|---|---|---|---|---|---|---|---|---|
| | C | Si | Mn | P | S | Ni | Cr | Mo | Cu | Others | N | B | | | | | |
| 1 | 0.014 | 0.69 | 2.06 | 0.019 | 0.001 | 8.13 | 22.31 | 1.02 | | | 0.101 | 0.0050 | 12.8 | 16.9 | 0.81 | 1235 | First |
| 2 | 0.013 | 0.67 | 2.10 | 0.021 | 0.002 | 8.30 | 22.33 | 1.52 | | | 0.100 | 0.0007 | 13.1 | 17.2 | 0.78 | 1344 | invention |
| 3 | 0.015 | 0.72 | 2.05 | 0.022 | 0.001 | 8.25 | 22.29 | 1.00 | | | 0.095 | 0.0060 | 12.7 | 18.7 | 0.80 | 1721 | |
| 4 | 0.016 | 0.69 | 2.01 | 0.020 | 0.002 | 8.21 | 22.22 | 1.03 | | | 0.099 | 0.0050 | 12.6 | 14.3 | 0.79 | 1623 | |
| 5 | 0.016 | 0.64 | 1.10 | 0.020 | 0.001 | 5.25 | 20.16 | 1.11 | | | 0.082 | 0.0020 | 14.3 | 16.1 | 0.83 | 1232 | |
| 6 | 0.015 | 0.71 | 2.03 | 0.020 | 0.002 | 8.20 | 22.25 | | | | 0.092 | | 11.8 | 15.3 | 0.79 | 925 | Comparative |
| 7 | 0.011 | 0.70 | 2.07 | 0.019 | 0.001 | 8.22 | 22.35 | 0.23 | | | 0.098 | | 12.1 | 18.2 | 0.81 | 1064 | invention |
| 8 | 0.014 | 0.71 | 2.12 | 0.023 | 0.001 | 8.32 | 22.21 | | | | 0.102 | 0.0060 | 11.4 | 16.2 | 0.76 | 1442 | |
| 9 | 0.013 | 0.68 | 2.11 | 0.023 | 0.001 | 8.29 | 22.31 | 2.50 | | | 0.094 | 0.0150 | 14.2 | 62.3 | 0.81 | 1525 | |
| 10 | 0.021 | 1.50 | 2.98 | 0.019 | 0.002 | 4.65 | 17.54 | 1.02 | 0.31 | | 0.091 | 0.0060 | 12.1 | 19.3 | 0.75 | 1333 | Second |
| 11 | 0.020 | 1.50 | 2.88 | 0.019 | 0.001 | 4.64 | 17.44 | 1.98 | 1.21 | | 0.111 | 0.0040 | 12.2 | 13.2 | 0.76 | 1435 | invention |
| 12 | 0.021 | 1.47 | 2.95 | 0.021 | 0.002 | 5.46 | 17.43 | 1.23 | 0.05 | | 0.132 | 0.0050 | 9.5 | 21.5 | 0.71 | 1353 | Comparative |
| 13 | 0.020 | 1.50 | 2.93 | 0.022 | 0.002 | 4.56 | 18.00 | 1.52 | 2.12 | | 0.100 | 0.0050 | 12.0 | 21.2 | 0.77 | 1010 | invention |
| 14 | 0.021 | 0.65 | 0.65 | 0.020 | 0.001 | 5.03 | 23.15 | 1.40 | 1.02 | REM: 0.005 | 0.139 | 0.0030 | 16.3 | 16.1 | 0.78 | 2023 | Third |
| 15 | 0.022 | 0.63 | 0.63 | 0.022 | 0.001 | 4.99 | 23.21 | 1.41 | 1.02 | REM: 0.013 | 0.141 | 0.0050 | 16.3 | 15.4 | 0.77 | 2351 | invention |
| 16 | 0.020 | 0.64 | 0.60 | 0.019 | 0.002 | 5.12 | 22.88 | 1.39 | 1.02 | REM: 0.003 | 0.137 | 0.0070 | 16.0 | 14.3 | 0.79 | 1822 | Comparative invention |
| 17 | 0.013 | 1.48 | 2.89 | 0.019 | 0.001 | 3.94 | 19.23 | 0.51 | 1.21 | | 0.081 | 0.0040 | 14.0 | 13.7 | 0.93 | 1525 | Forth |
| 18 | 0.021 | 0.51 | 1.21 | 0.018 | 0.002 | 3.85 | 20.81 | 0.55 | 0.25 | | 0.083 | 0.0060 | 15.3 | 15.2 | 0.86 | 1622 | invention |
| 19 | 0.022 | 0.49 | 1.15 | 0.020 | 0.002 | 3.91 | 20.75 | 1.43 | 1.02 | | 0.091 | 0.0070 | 15.4 | 14.6 | 0.88 | 1823 | |
| 20 | 0.021 | 1.49 | 2.96 | 0.020 | 0.001 | 4.51 | 17.72 | 0.52 | | | 0.110 | 0.0050 | 11.5 | 33.1 | 0.62 | 1022 | Comparative |
| 21 | 0.015 | 0.56 | 0.56 | 0.022 | 0.002 | 3.23 | 25.32 | 1.55 | 0.10 | | 0.099 | 0.0110 | 21.7 | 53.2 | 0.33 | 989 | invention |
| 22 | 0.021 | 0.65 | 0.65 | 0.021 | 0.001 | 4.52 | 25.31 | 1.47 | 0.12 | REM: 0.020 | 0.111 | 0.0080 | 20.0 | 45.3 | 0.42 | 1522 | |

*$Cr_{eq}$ − $Ni_{eq}$ = Cr + Mo + 1.5Si—Ni-30C-0.5Mn-0.5Mn-0.5Cu-20N

Figure 2:
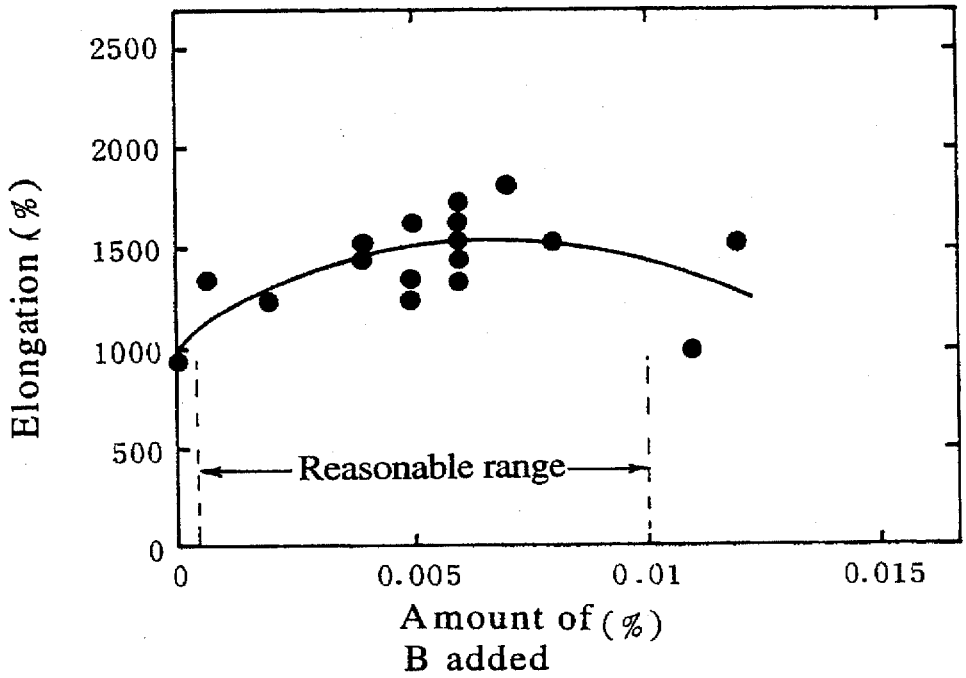
FIG. 2 is a graph showing a relation between elongation and amount of B added.

Then, tests are carried out with respect to the influence of B addition upon the flow stress or elongation. The results are shown in FIGS. 1 and 2. As seen from the results of FIGS. 1 and 2, the elongation tends to be increased by the B addition, while the flow stress increases with the increase of the amount of B added. Considering the balance among the elongation, flow stress and m-value, when the amount of B added is within a range of 0.0005–0.01 wt %, the superplastic work can be attained at a low temperature region of about 900° C. without causing troubles in the forming.

Figure 3:
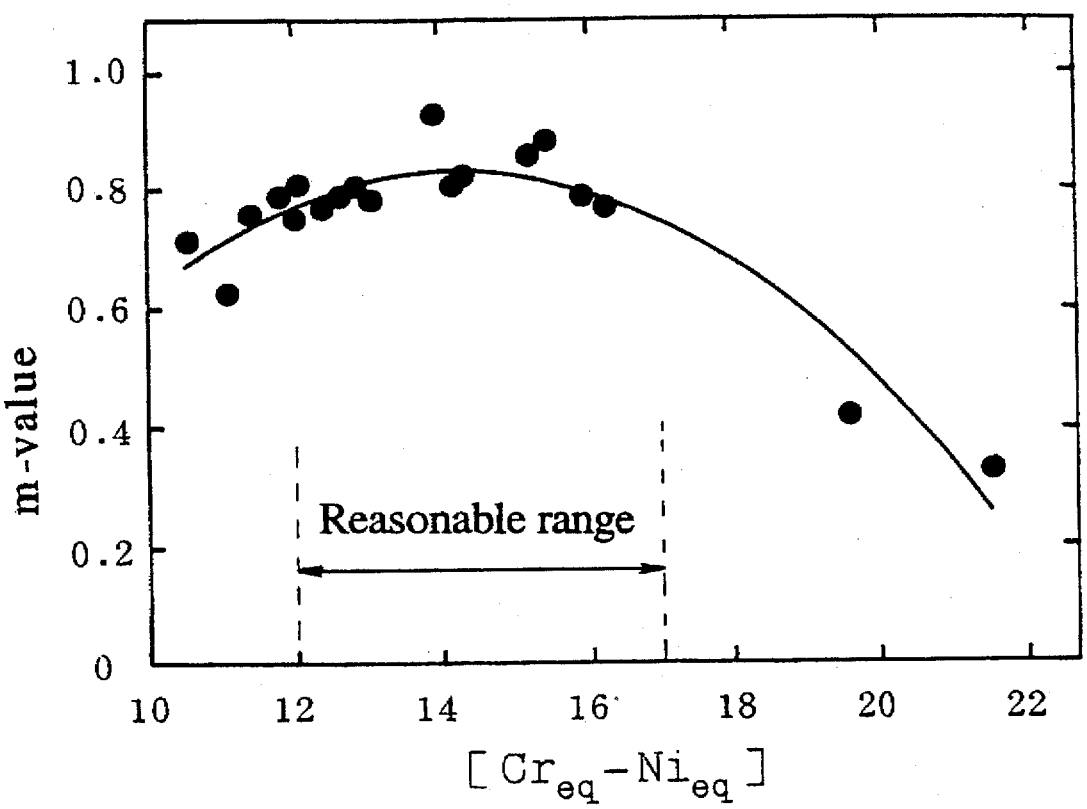
FIG. 3 is a graph showing a relation between strain rate exponent (m-value) and $[Cr_{eq}-Ni_{eq}]$.

Furthermore, tests are carried out with respect to the influence of [$Cr_{eq}$–$Ni_{eq}$] upon the m-value. The results are shown in FIG. 3. As seen from the results of FIG. 3, the m-value becomes high when the value of [$Cr_{eq}$–$Ni_{eq}$] is within a range of 12–17 and the good superplasticity is obtained at the m-value of the above range.

As mentioned above, the superplastic dual-phase stainless steels according to the invention are materials having low flow stress and high m-value without precipitating σ phase at about 900° C., so that the superplastic work can be realized at a low temperature region of about 900° C. According to the invention, very practical products causing no problems such as brittleness and degradation of corrosion resistance are obtained because the products after the work have no σ phase.

Therefore, the invention contributes to more enlarge the application range of iron-base superplastic material and is possible to conduct superplastic joining to Ti alloy or the like which has never been carried out by the conventional technique owing to the difference of forming temperature.

What is claimed is:

1. A superplastic dual-phase stainless steel having a low deformation resistance and an excellent elongation, comprising C: not more than 0.05 wt %, Si: not more than 1.5 wt %, Mn: not more than 3.0 wt %, Cr: 17.0–26.0 wt %, Ni: 3.0–10.0 wt %, Mo: 0.1–2.0 wt %, N: 0.08–0.20 wt %, S: not more than 0.002 wt %, B: 0.0005–0.01 wt % and the remainder being Fe and inevitable impurities, wherein contents of Cr, Ni, Mo, Si, C, Mn, Cu, and N satisfy a difference $Cr_{eq}$–$Ni_{eq}$ between $Cr_{eq}$ defined by the following equation (1) and $Ni_{eq}$ defined by the following equation (2) of 12.0–17.0.

$$Cr_{eq}=Cr+Mo+0.5Si \quad (1)$$

$$Ni_{eq}=Ni+30C+0.5Mn+0.5Cu+20N \quad (2).$$

2. A superplastic dual-phase stainless steel having a low deformation resistance and an excellent elongation, comprising C: not more than 0.05 wt %, Si: not more than 1.5 wt %, Mn: not more than 3.0 wt %, Cr: 17.0–26.0 wt %, Ni: 3.0–10.0 wt %, Mo: 0.1–2.0 wt %, N: 0.08–0.20 wt %, S: not more than 0.002 wt %, B: 0.0005–0.01 wt %, Cu: 0.1–2.0 wt % and the remainder being Fe and inevitable impurities, wherein contents of Cr, Ni, Mo, Si, C, Mn, Cu, and N satisfy a difference $Cr_{eq}$–$Ni_{eq}$ between $Cr_{eq}$ defined by the following equation (1) and $Ni_{eq}$ defined by the following equation (2) of 12.0–17.0.

$$Cr_{eq}=Cr+Mo+0.5Si \quad (1)$$

$$Ni_{eq}=Ni+30C+0.5Mn+0.5Cu+20N \quad (2).$$

3. A superplastic dual-phase stainless steel according to claim 1, wherein the steel further contains 0.005–0.05 wt % of REM (rare earth element).

* * * * *